US006607566B1

(12) United States Patent
Coleman et al.

(10) Patent No.: US 6,607,566 B1
(45) **Date of Patent: *Aug. 19, 2003**

(54) STABILE FUEL EMULSIONS AND METHOD OF MAKING

(75) Inventors: Gerald N. Coleman, Peoria, IL (US); Dennis L. Endicott, Mapleton, IL (US); Edward A. Jakush, Evanston, IL (US); Alex Nikolov, Chicago, IL (US)

(73) Assignee: Clean Fuel Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,875

(22) Filed: Jul. 1, 1998

(51) Int. Cl.[7] ..... C10L 1/32
(52) U.S. Cl. ..... 44/301; 44/302
(58) Field of Search ..... 44/301, 302

(56) References Cited

U.S. PATENT DOCUMENTS 5,259,851 A * 11/1993 Genova et al. ..... 44/302
5,284,492 A * 2/1994 Dubin ..... 44/302
5,372,613 A * 12/1994 Mekonen ..... 44/301
5,445,656 A * 8/1995 Marelli ..... 44/302
5,669,938 A * 9/1997 Schwab ..... 44/301
5,743,922 A * 4/1998 Peter-Hoblyn et al. ..... 44/302
5,873,916 A * 2/1999 Cemenska et al. ..... 44/301

FOREIGN PATENT DOCUMENTS

| | | |
|---|---|---|
| EP | 0301766 | 2/1989 |
| WO | 95/27021 | 10/1995 |
| WO | 98/12285 | 3/1998 |

* cited by examiner

*Primary Examiner*—Cephia D. Toomer
(74) *Attorney, Agent, or Firm*—Sierra Patent Group, Ltd.

(57) ABSTRACT

An improved method for producing highly stabile aqueous fuel emulsions. The method provides for selectively combining prescribed quantities of diesel fuel, purified water, alcohol, and an additive package and emulsifying the fuel mixture using a high shear mixer. The optimum viscosity and stability in the aqueous fuel emulsion is achieved by bypassing a selected quantity of the fuel emulsion around the high shear mixing device such that the final fuel emulsion includes a bi-modal droplet size distribution having droplet sizes less than about 15 microns in size. Additional stability and performance features of the aqueous fuel emulsion are attributed to the contents of the additive package that includes a combination of surfactants, lubricity additive, cetane improvers, citric acid, and methanol wherein each of the various additives may perform multiple functions.

35 Claims, No Drawings

STABILE FUEL EMULSIONS AND METHOD OF MAKING

BACKGROUND OF THE INVENTION

The present invention relates to reduced nitrogen oxide (NOx) emission fuel compositions, more particularly, to high stability aqueous fuel compositions for use in internal combustion engines.

Nitrogen oxides comprise a major irritant in smog and are believed to contribute to tropospheric ozone which is a known threat to health. Environmental considerations and government regulations have increased the need to reduce NOx production. One problem with using diesel-fueled engines is that relatively high flame temperatures reached during combustion increase the tendency for the production of nitrogen oxides (NOx). These are formed from both the combination of nitrogen and oxygen in the combustion chamber and from the oxidation of organic nitrogen species in the fuel. Various methods for reducing NOx production include the use of catalytic converters, engine timing changes, exhaust recirculation, and the burning of "clean" fuels. These methods are generally too expensive and/or too complicated to be placed in widespread use. The rates at which NOx are formed is related to the flame temperature. It has been shown that a small reduction in flame temperature can result in a large reduction in the production of nitrogen oxides.

One approach to lowering the flame temperature is to inject water in the combustion zone, however; this requires costly and complicated changes in engine design. An alternate method of using water to reduce flame temperature is the use of aqueous fuels, i.e., incorporating both water and fuel into an emulsion. Problems that may occur from long-term use of aqueous fuels include engine corrosion, engine wear, or precipitate deposition which may lead to engine problems and ultimately to engine inoperability. Problematic precipitate depositions include coalescing ionic species resulting in filter plugging and inorganic post combustion deposits resulting in turbo fouling. Another problem related to aqueous fuel compositions is that they often require substantial engine modifications, such as the addition of in-line homogenizers, thereby limiting their commercial utility.

A significant barrier to the commercial use of aqueous fuel emulsions is emulsion stability. Gravitational phase separation (during storage) and high temperature, high pressure/shear flow rate phase separation (in a working engine) of these emulsions has prevented successful commercialization.

The present invention addresses the problems associated with the use of aqueous fuel compositions by providing a stabile, inexpensive fuel emulsion with reduced NOX and particulate emissions.

SUMMARY OF THE INVENTION

In general, the invention features a substantially ashless fuel composition that comprises hydrocarbon petroleum distillate, purified water, and an additive composition. The fuel composition preferably is in the form of an emulsion having an average droplet diameter of less than about 10 microns, which is stable at storage temperatures, as well as, at temperatures and pressures encountered during use, such as, during recirculation in a compression ignited engine.

The process for making the emulsions greatly effects the stability of the resulting compositions. The components are mixed in a serial, continuous flow process. This process allows for the continuous monitoring and instantaneous adjustment of the flow, and thus content, of each component in the final mixture. After all components are mixed, the composition is aged prior to passing it through a shear pump. The aging time is temperature dependent. The resulting emulsion is a macro-emulsion having an average droplet size of less than about 10 microns.

The amount of the hydrocarbon petroleum distillate preferably is between about 43 weight percent and about 70 weight percent of the fuel composition, more preferably between about 63 weight percent and about 68 weight percent of the fuel composition.

The amount of purified water preferably is between about 28 weight percent and about 55 weight percent of the fuel composition, more preferably between about 30 weight percent and about 35 weight percent of the fuel composition. The purified water preferably contains no greater than about 50 parts per million calcium and magnesium ions, and no greater than about 20 parts per million silicon. More preferably, the purified water has a Total hardness of less than 10 parts per million and contains no greater than about 2 parts per million calcium and magnesium ions, and no greater than about 1 part per million silicon.

The additive composition preferably includes a surfactant and may also include one or more additives such as lubricants, corrosion inhibitors, antifreezes, ignition delay modifiers, cetane improvers, stabilizers, rheology modifiers, and the like. Individual additive ingredients may perform one or more of the aforementioned functions.

DESCRIPTION OF PREFERRED EMBODIMENTS

Preferred fuel compositions include hydrocarbon petroleum distillates and water, preferably in the form of an emulsion. The preferred emulsion is a stable system with as little surfactant as possible. A stable emulsion is desirable because a separate water phase will lead to combustion problems. Stability means no substantial phase separation in long term storage under typical storage conditions, for example up to about three months. A small amount of phase separation in the storage tank containing the fuel composition may be tolerated because pumping the fuel composition will ensure sufficient emulsification. High temperature, high pressure stability is also required to maintain the emulsion under operating conditions.

The fuel composition is preferably ashless. For the purposes of this disclosure "ashless" means that, once the fuel components are combined, the level of particulates and coalescing ionic species is sufficiently low to allow long-term operation of the internal combustion engine (for example, substantially continuous operation for three months) without significant particulate and coalescing ionic species deposition on engine parts, including valve seats and stems, injectors and plug filters, and post-combustion engine parts such as the exhaust trains and turbo recovery units. The level of ash is determined by monitoring water purity, exhaust emissions, and by engine autopsy. Engine autopsy, including dismantlement and metallurgical analysis, is also used to analyze corrosion and wear.

Preferred compositions include about 43% to about 70% by weight hydrocarbon petroleum distillate, more preferably about 63% to about 68% hydrocarbon petroleum distillate. The amount and type of hydrocarbon petroleum distillate is selected so that the kilowattage per gallon provided by combusting the fuel composition is sufficiently high so that the engine need not be derated. Such hydrocarbon petroleum distillates include high paraffinic, low aromatic hydrocarbon petroleum distillates having an aromatic content of less than about 10%, preferably less than about 3%. Examples of suitable hydrocarbon petroleum distillates include kerosene, diesel, naphtha, and aliphatics and paraffinics, used alone or in combination with each other, with diesel being preferred, for example, EPA Emissions Certification Diesel Fuel and standard number 2 diesel.

The water component of the fuel composition functions to reduce NOx and particulate emissions. The greater the amount of water, the greater the decrease in NOx emissions. The current upper limit of water is about 55%, above which the burning characteristics of the fuel make it's use impractical under normal conditions, i.e., with an acceptable amount of additives and relatively inexpensive hydrocarbon petroleum distillate. The preferred amount of purified water is between about 28 weight percent and about 55 weight percent of the fuel composition, more preferably between about 30 weight percent and about 35 weight percent of the fuel composition.

The water is preferably purified such that it contains very low concentrations of ions and other impurities, particularly calcium ions, magnesium ions, and silicon. This is desirable because impure water contributes to ashing and engine deposit problems after long-term use, which can lead to wear, corrosion, and engine failure. The purified water preferably contains no greater than about 50 parts per million calcium and magnesium ions, and no greater than about 20 parts per million silicon. More preferably, the purified water has a Total hardness of less than 10 parts per million and contains no greater than about 2 parts per million calcium and magnesium ions, and no greater than about 1 part per million silicon. Suitable purification techniques are well-known and include distillation, ion exchange treatment, and reverse osmosis, with reverse osmosis being preferred due to lower cost and ease of operation.

The composition preferably includes less than 10% of an additive containing, for example, one or more of the following: surfactants, lubricants, corrosion inhibitors, antifreezes, ignition delay modifiers, cetane improvers, stabilizers, rheology modifiers, and the like. The amount of additive selected is preferably sufficiently high to perform its intended function and, preferably sufficiently low to control the fuel composition cost. The additives are preferably sufficiently high to perform its intended function and, preferably sufficiently low to control the fuel composition cost. The additives are preferably selected so that the fuel composition is ashless.

In a preferred embodiment the water functions as the continuous phase of an emulsion, acting as an extender and carrier of the hydrocarbon petroleum distillate. As the continuous phase, the lower useable limit of water is theoretically about 26%, below which point the physics of the system inhibits maintaining water as the continuous phase.

The composition preferably includes surfactant which facilitates the formation of a stable emulsion of the hydrocarbon petroleum distillate within the continuous water phase. A preferred surfactant is a surfactant package comprised of one or more surfactants in combination with one or more surfactant stabilizers. Preferred surfactants are ashless and do not chemically react with other components in the fuel composition. Suitable surfactants include nonionic, anionic and amphoteric surfactants. Preferred fuel compositions include about 0.3% to about 1.0% by weight, preferably about 0.4% to about 0.6% total surfactant. Examples of surfactants include alkylphenolethoxylates, alcohol ethoxylates, fatty alcohol ethoxylates, and alkyl amine ethoxylates. Of these, the alkylphenolethoxylates and alcohol ethoxylates are preferred. Of the alkylphenolethoxylates, polyethoxylated nonylphenols having between 8 and 12 moles of ethylene oxide per mole of nonylphenol are preferred. An example nonylphenol, 2,6,8-Trimethyl-4-nonyloxypolyethyleneoxyethanol is commercially available, e.g., from Union Carbide under the trade designation "TERGITOL TMN-10". Another nonylphenol ethoxylate NP-9 available from Shell under the trade designation "NP-9EO", added at 1000–3000 ppm. A preferred alcohol ethoxylate is a $C_{11}$ alcohol ethoxylate with 5 moles of ethylene oxide per mole of alcohol commercially available from Shell as "Neodol N1-5 Surfactant". Additional preferred surfactant components include, for example, Pluronic 17R-2 [octylphenoxypolyethoxyethanol] (a block copolymer produced by BASF) added at 100–300 ppm; CA-720 an octylphenol aromatic ethoxylate available from Rhone-Poulenc as "Igepal CA-720" added at 1000–3000 ppm; and X-102 an ethoxylated alkyl phenol available from Union Carbide as "TRITON X-102" added at 1000–2000 ppm.

The fuel composition preferably includes one or more lubricants to improve the slip of the water phase and for continued smooth operation of the fuel delivery system. The amount of lubricant generally ranges from about 0.04% to 0.1% by weight, more preferably from 0.04% to 0.05% by weight. Suitable lubricants include a combination of mono-, di-, and tri-acids of the phosphoric or carboxylic types, adducted to an organic backbone. The carboxylic types are more preferred because of their ashless character. Examples include mixed esters of alkoxylated surfactants in the phosphate form, and di- and tri-acids of the Diels-Alder adducts of unsaturated fatty acids. The organic backbone preferably contains about 12 to 22 carbons. A specific example of a suitable lubricant is Diacid 1550™ (Atrachem Latol 1550 or Westvaco Chemicals Diacid 1550), which is preferred due to its high functionality at low concentrations. The Diacid 1550 also has nonionic surfactant properties.

Neutralization of the phosphoric and carboxylic acids, preferably with an alkanolamine, reduces possible corrosion problems caused as a result of the addition of the acid. Suitable alkanolamine neutralizers include amino methyl propanol, triethanolamine, and diethanolamine, with amino methyl propanol (available from Angus Chemical under the trade designation "AMP-95") being preferred. Preferred compositions include about 0.05 to 0.4% by weight neutralizer, more preferably about 0.06%.

The fuel composition may also include one or more corrosion inhibitors, preferably one that does not contribute a significant level of inorganic ash to the composition. Aminoalkanoic acids are preferred. An example of a suitable corrosion inhibitor is available from the Keil Chemical Division of Ferro Corporation under the trade designation "Synkad 828". Preferred compositions include about 0.05% by weight corrosion inhibitor.

The fuel composition may also include one or more ignition delay modifiers, preferably a cetane improver, to improve fuel detonation characteristics, particularly where the fuel composition is used in compression ignited engines. Examples include nitrates, nitrites, and peroxides. The preferred ignition delay modifier is 2-ethylhexylnitrate (2-EHN), available from Ethyl Corporation under the trade designation "HiTec 4103". Ammonium nitrate can also be used as a known cetane improver. Preferred compositions include about 0.1% to 0.4% by weight ignition delay modifier.

An antifreeze may also be included in the fuel composition. Organic alcohols are preferred. Specific examples include methanol, ethanol, isopropanol, and glycols, with methanol being preferred. The amount of antifreeze preferably ranges from about 2% to about 9% by weight.

Biocides known to those skilled in the art may also be added, provided they are ashless. Antifoam agents known to those skilled in the art may be added as well, provided they are ashless. The amount of antifoam agent preferably is not more than 0.0005% by weight.

The fuel composition may also include one or more coupling agents (hydrotropes) to maintain phase stability at high temperatures and shear pressures. High temperature and shear pressure stability is required, for example, in compression ignited (diesel) engines because all the fuel delivered to the injectors may not be burned to obtain the required power load in a given cycle. Thus, some fuel may be recirculated back to the fuel tank The relatively high temperature of the recirculated fuel, coupled with the shear pressures encountered during recirculation, tends to cause phase separation in the absence of the coupling agent.

Examples of preferred coupling agents include di-and tri-acids of the Diels-Alder adducts of unsaturated fatty acids. A specific example of a suitable coupling agent is Diacid 1550, neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%.

The fuel composition includes additives which perform multiple functions. For example, Diacid 1550 acts as a surfactant, lubricant, and coupling agent. Similarly, AMP-95 acts as a neutralizer and helps maintain the pH of the fuel composition and, if used, ammonium nitrate acts as a cetane improver and an emulsion stabilizer.

A preferred fuel composition has the following composition: 67% by weight diesel, 30% by weight water, 2% by weight methanol, 0.16% by weight X-102; 0.08% by weight N1-5; 0.08% by weight TMN-10, 0.04% Diacid 1550, 0.06% AMP-95, 0.05% Synkad 828, and 0.37% 2-ethylhexylnitrate.

Emulsion Process

The fuel compositions are manufactured using a continuous flow process capable of continuous monitoring and adjustment which can provide the shear rates necessary to form the desired droplet size for a stable emulsion.

The process uses a fuel emulsion blending system including a first inlet circuit adapted for receiving hydrocarbon petroleum distillate from the source of hydrocarbon petroleum distillate; a second inlet circuit adapted for receiving aqueous fuel emulsion additives from the source of aqueous fuel emulsion additives; a third inlet circuit adapted for receiving water from the source of water. The blending system further includes a first blending station adapted to mix the hydrocarbon petroleum distillate and aqueous fuel emulsion additives and a second blending station adapted to mix the hydrocarbon and additive mixture received from the first blending station together with the water received from the source of water. The blending system further includes an emulsification station downstream of the blending stations, which is adapted to emulsify the mixture of hydrocarbon petroleum distillate, additives and water to yield a stable aqueous fuel emulsion. The present embodiment of the blending system is operatively associated with a blending system controller which is adapted to govern the flow of the hydrocarbon petroleum distillate, water and aqueous fuel emulsion additives thereby controlling the mixing ratio in accordance with prescribed blending ratios.

In an example of a continuous process, the additives are combined in the form of a stream, and then fed to a first in-line blending station where they are combined with a hydrocarbon petroleum distillate stream. The resulting product is then combined with water in a second in-line blending station to form the fuel composition, which is then aged in a reservoir and then pumped using a shear pump to a storage tank. In an alternate embodiment, a separate stream of the antifreeze (alcohol) is combined with the other additives in an in-line blending station and then this combined additive stream is fed to the first in-line blending station.

FIG. 1 illustrates a schematic representation of a preferred aqueous fuel emulsion blending system 12 having a plurality of ingredient inlets and an aqueous fuel emulsion outlet 14. As seen therein, the preferred embodiment of the fuel blending system 12 comprises a first fluid circuit 16 adapted for receiving hydrocarbon petroleum distillate at a first ingredient inlet 18 from a source of hydrocarbon petroleum distillate (not shown) and a second fluid circuit 20 adapted for receiving fuel emulsion additives at a second ingredient inlet 22 from an additive storage tank 24 or similar such source of fuel emulsion additives. The first fluid circuit 16 includes a fuel pump 26 for transferring the hydrocarbon petroleum distillate, preferably a diesel fuel, from the source of hydrocarbon petroleum distillate to the blending system 12 at a selected flow rate, a 10 micron filter 28, and a flow measurement device 30 adapted to measure the flow rate of the incoming hydrocarbon petroleum distillate stream. The second fluid circuit 22 also includes a pump 32 for transferring the additives from the storage tank 24 to the blending system 12 at prescribed flow rates. The fuel additive flow rate within the second fluid circuit 20 is controlled by a flow control valve 34 interposed between the additive storage tank 24 and the pump 26. As with the first fluid circuit 16, the second fluid circuit 20 also includes a 10 micron filter 36 and a flow measurement device 38 adapted to measure the controlled flow rate of the incoming additive stream. The signals 40, 42 generated from the flow measurement devices 30, 38 associated with the first and second fluid circuits are further coupled as inputs to a blending system controller 44.

The first fluid circuit 16 transporting the hydrocarbon petroleum distillate and the second fluid circuit 20 adapted for supplying the fuel additives are coupled together and subsequently mixed together using a first in-line mixer 46. The resulting mixture of hydrocarbon petroleum distillate and fuel additives is then joined with a purified water stream supplied via a third fluid circuit 50 and subsequently mixed together using a second in-line mixer 51.

The third fluid circuit 50 includes a water pump 54 for transferring the purified water from a source of clean or purified water (not shown) at a selected flow rate to the blending system 12, a particulate filter 56 and a flow measurement device 58 adapted to measure the flow rate of the incoming purified water stream. The water pump 54, filter 56 and flow measurement device 58 are serially arranged within the third fluid circuit 50. The water flow rate within the third fluid circuit 50 is preferably controlled using a flow control valve 60 interposed between the clean water source and the water pump 54 proximate the third or water inlet 62. The third fluid circuit 50 also includes a specific conductance measurement device 64 disposed downstream of the flow measurement device 58 and adapted to monitor the quality of the water supplied to the blending system 12. The signals 66, 68 generated from the flow measurement device 58 and the specific conductance measurement device 64 in the third fluid circuit 50 are provided as inputs to the blending system controller 44. If the water quality is too poor or below a prescribed threshold, the blending system controller 44 disables the blending system 12 until corrective measures are taken. In the preferred embodiment, the water quality threshold, as measured using the specific conductance measurement device 64 should be no greater than 20 microsiemens per centimeter. As indicated above, the purified water from the third fluid circuit 50 is joined with the hydrocarbon petroleum distillate and fuel additive mixture and subsequently re-mixed using the second in-line mixer 52 or equivalent blending station equipment.

The resulting mixture or combination of hydrocarbon petroleum distillate, fuel emulsion additives, and purified water are fed into an emulsification station 70. The emulsification station 70 includes an aging reservoir 72, and emulsifier. The aging reservoir 72 includes an inlet 74, an outlet 76 and a high volume chamber 78 or reservoir. The preferred embodiment of the blending system 12 operates using a three-minute aging time for the aqueous fuel emulsion. In other words, a blending system operating at an output flow rate of about 15 gallons per minute would utilize a 45-gallon tank as an aging reservoir. The incoming stream of hydrocarbon petroleum distillate, fuel emulsion additives, and purified water are fed into the aging reservoir 72 at a location that preferably provides continuous agitation to the reservoir. The preferred embodiment of the blending system 12 also includes a high shear pump 80 and a pressure regulating valve 32 disposed downstream of the aging reservoir 72 which provides the final aqueous fuel emulsion at the blending system outlet 14.

As indicated above, the blending system controller 44 accepts as inputs the signals generated by the various flow measurement devices in the first, second and third fluid circuits, as well as any signals generated by the water quality measurement device together with various operator inputs such as prescribe fuel mix ratios and provides control signals for the flow control valve in the second fluid circuit and the flow control valve in the third fluid circuit. The illustrated embodiment of the blending system is preferably configured such that the hydrocarbon petroleum distillate stream is not precisely controlled by is precisely measured. Conversely, the purified water feed line and the fuel additive feed line are precisely controlled and precisely measured to yield a prescribed water blend fuel mix. The illustrated embodiment also shows the hydrocarbon petroleum distillate, purified water and fuel additive streams to be continuous feed so that the proper fuel blend ratio is continuously delivered to the shear pump. Alternatively, however, it may be desirable to configure the blending system such that the purified water stream is precisely measured but not precisely controlled while precisely controlling and measure the hydrocarbon petroleum distillate feed line and the fuel additive feed line to yield a prescribed water blend fuel mix.

Examples of shear pumps capable of the necessary high shear rates are the Ross X Series mixer and the Kady Mill. The preferred shear pump is a Kady Mill, running at between about 20 Hz and 60 Hz, preferably about 40 Hz. As in the case of the batch process, the product is in the form of a stable, homogeneous, milky emulsion having an average droplet diameter of less than 10 microns, preferably ranging from about 4 to about 6 microns.

In another preferred embodiment of the process, 10% to 50% of the flow from the reservoir is sent directly to the storage tank, by-passing the shear pump. This results in an emulsion having bi-modal distribution of preferred droplet diameters. The bi-modal distribution enhances stability while allowing for an optimal viscosity. The percentage is adjusted to obtain optimal viscosity and stability of the final emulsion.

Engine Design

The aqueous fuel compositions according to the invention can be used in internal combustion engines without substantially modifying the engine design. For example, the fuel compositions can be used without re-designing the engine to include in-line homogenizers. To enhance fuel efficacy, however, several readily implemented changes are preferably incorporated in the engine structure.

The capacity of the engine fuel system may be increased to use the fuel compositions in diesel engines. The increased capacity is a function of the percentage of water in the fuel. The engine fuel system capacity is typically scaled by the following ratio:

$$\frac{\text{Lower Heating Value of Diesel Fuel (btu/gal)}}{\text{Lower Heating Value of Fuel Composition (btu/gal)}}$$

In many cases, the engine fuel system capacity can be increased sufficiently by increasing the injector orifice size. Other engines may require an increase in the capacity of the injection pump. In addition, an increase in the capacity of the fuel transfer pump may be required.

Some modifications to the engine may be required to compensate for fuel compositions with cetane quality lower than diesel fuel. This may include advancing the fuel injection timing to improve operation at light load, during starting, and under warm up conditions. In addition, a jacket water aftercooler may be required to warm the intake air under light load conditions. The use of a block heater or an inlet air heater may be required to improve cold starting capability.

The following examples will further describe the invention. These examples are intended only to be illustrative. Other variations and modifications may be made in form and detail described herein without departing from or limiting the scope of the invention which is determined by the attached claims.

EXAMPLES DO NOT INCLUDE AN EXAMPLE OF CONTINUOUS FLOW PROCESS WE ARE CLAIMING!!!

EXAMPLE 1

An aqueous fuel composition having the following formula was prepared:

| | ppm | Percent |
|---|---|---|
| Diesel fuel | (balance) | 67% |
| H2O | 300,000 | 30.00% |
| MeOH | 20,000 | 2.00% |
| X-102 | 1,600 | 0.16% |
| N1-5 | 800 | 0.08% |
| TMN-10 | 800 | 0.08% |
| DA-1550 | 400 | 0.04% |
| AMP-95 | 600 | 0.06% |
| Synkad 828 | 500 | 0.05% |
| 2-EHN | 3,700 | 0.37% |

The fuel is prepared by first mixing the Diacid 1550, AMP-95, Synkad 828, X-102, N1-5, and TMN-10 with the methanol. The mixture is agitated.

The mixture is charged into a vessel with the reverse osmosis purified water and agitated for about 1–5 minutes. Then the F-173 and 2-ethylhexyl nitrate are charged into the vessel, and the composition is agitated for 15–30 minutes. The mixing vessel is a Lightnin Blender, and all mixing is carried out under ambient conditions.

The aqueous fuel composition is then pumped through a Kady Mill shear pump at a shear rate of 40 Hz resulting in a homogeneous, milky emulsion having an average droplet diameter of about 4 to about 6 microns. The fuel composition is stored at ambient temperatures.

EXAMPLE 2

A fuel composition was prepared by the method of Example 1, having the formula:

| | |
|---|---|
| Diesel Fuel | 67% |
| Highly purified water | 30% |
| Methanol | 2.00% |
| 2-EHN | 0.37% |
| DA-1550 | 400 ppm |
| AMP 95 | 600 ppm |
| Synkad 828 | 500 ppm |
| N1-5 | 1000 ppm |
| NP 9 | 3000 ppm |

EXAMPLE 3

A fuel composition was prepared by the method of Example 1, having the formula:

| | |
|---|---|
| Diesel Fuel | 67% |
| Highly purified water | 30% |
| Methanol | 2.00% |
| 2-EHN | 0.37% |
| DA-1550 | 400 ppm |
| AMP 95 | 600 ppm |
| Synkad 828 | 500 ppm |
| TMN 10 | 1000 ppm |
| NP 9 | 2000 ppm |
| 17R2 | 100 ppm |

EXAMPLE 4

A fuel composition was prepared by the method of Example 1, having the formula:

| | |
|---|---|
| Diesel Fuel | 67% |
| Highly purified water | 30% |
| Methanol | 2.00% |
| 2-EHN | 0.37% |
| DA-1550 | 400 ppm |
| AMP 95 | 600 ppm |
| Synkad 828 | 500 ppm |
| N1-5 | 1000 ppm |
| TMN 10 | 1000 ppm |
| CA 720 | 2000 ppm |

For Examples 1–4 the Diesel fuel used was EPA Emissions Certification Diesel Fuel;

the water was purified by reverse osmosis;

X-102 is Union Carbide Triton X-102;

TMN-10 is Union Carbide Tergitol TMN-10 surfactant;

N1-5 is Shell Neodol N1-5 surfactant;

DA-1550 is Atrachem Latol 1550 (or Westavco Chemicals Diacid 1550);

AMP-95 is 2-amino-2-methyl-1-propanol.

Synkad 828 is Ferro Synkad 828;

2-EHN is Ethyl Corp. 2-ethylhexyl nitrate;

CA-720 is Rhone-Poulenc "Igepal CA-720";

NP 9 is Shell "NP-9EO"; and

17R2 is BASF "Pluronic 17R-2".

EXAMPLE 5

The fuel compositions prepared according to Examples 1, 2, 3, and 4 were run in a diesel engine to monitor NOx and particulate emissions. The engine used was a Caterpillar 12 liter compression-ignited truck engine (four stroke, fully electronic, direct injected engine with electronic unit injectors, a turbocharger, and a four valve quiescent head) The Caterpillar C-12 truck engine was rated at 410 hp at 1800 rpm with a peak torque of 2200 N-m at 1200 rpm and was modified to run a fuel-in-water emulsion. A simulated air-to-air aftercooler (43° C. inlet manifold temperature) was used.

The electronic unit injectors were changed to increase the quantity of fuel injected into the cylinder. As modified, the electronic unit injector Caterpillar Part Number 116-8800 replaced the standard injector Caterpillar Part Number 116-8888. In addition, the electronic control strategy was optimized with respect to emissions, fuel consumption, and cold starting.

Tests were performed on standard diesel fuels and on fuel emulsions of Example 1 and fuel emulsions prepared as in Example 1 in which the diesel fuel was Carb Diesel; RME (Rapeseed Methyl Ester); and Fischer Tropsch diesel. The tests were performed at 1800 rpm and 228 kW, 122 rpm and 197 kW, and 1800 rpm and 152 kW. Particulate emissions and NOx+HC emissions for standard diesel fuels and for fuel emulsions are shown in the following table:

| Engine | | Standard diesel fuel | Fuel emulsions |
|---|---|---|---|
| 1800 rpm 228 kW | Particulate emissions (g/hp-hr) | about 0.040 to about 0.055 | about 0.025 to about 0.055 |
| | NOx + HC emissions (g/hp-hr) | about 2.5 to about 4.5 | about 1.0 to about 2.8 |
| 1200 rpm 197 kW | Particulate emissions (g/hp-hr) | about 0.03 to about 0.033 | about 0.028 to about 0.1 |
| | NOx + HC emissions (g/hp-hr) | about 3.5 to about 6.5 | about 1.5 to about 4.2 |
| 1800 rpm 152 kW | Particulate emissions (g/hp-hr) | about 0.068 to about 0.084 | about 0.038 to about 0.050 |
| | NOx + HC emissions (g/hp-hr) | about 2.3 to about 4.5 | about 1.1 to about 2.7 |

EXAMPLE 6

The Ball on Three Disks (BOTD) lubricity test was utilized to assess the lubricity of the fuel compositions. This test was developed by Falex Corporation to assess the lubricity of various diesel fuels and their additives. The average wear scar diameter is used to assess fuel composition lubricity;

a smaller scar diameter implies a higher fuel composition lubricity. Typical diesel fuel will have a scar diameter of 0.45 mm to 0.55 mm. Fuel emulsions of Example 1 and fuel emulsions prepared as in Example 1 in which the diesel fuel was Carb Diesel; RME (Rapeseed Methyl Ester); and Fischer Tropsch diesel, ranged from about 0.547 to about 0.738.

What is claimed is:

1. A process for making a water continuous fuel emulsion composition for internal combustion engines comprising:

a) blending a flow of an additive composition with a flow of a hydrocarbon petroleum distillate in an in-line blending station to form a first composition;

b) blending said first composition with a flow of purified water in a second in-line blending station to form a second composition;

c) aging said second composition in a reservoir; and d) passing said second composition from said reservoir through a shear pump to form the water continuous fuel emulsion.

2. The process of claim 1 further including passing said second composition through said shear pump to a storage tank.

3. The process of claim 1 wherein passing said second composition from said reservoir through said shear pump to form the water continuous fuel emulsion results in said water continuous fuel emulsion having an average droplet size of less than 10 microns.

4. The process of claim 1 wherein about 50–90% of said second composition is passed through the shear pump to a storage tank and the remaining said second composition is passed directly to said storage tank.

5. The process of claim 1 wherein blending said first composition with a flow of said purified water in a second in-line blending station to form a second composition comprises blending said purified water in an amount to form about 26–55% by weight of said purified water in said water continuous fuel emulsion.

6. The process of claim 1 wherein blending said first composition with a flow of said purified water in a second in-line blending station to form a second composition comprises blending said purified water in an amount to form about 30–35% by weight of said purified water in said water continuous fuel emulsion.

7. The process of claim 1 wherein blending a flow of said hydrocarbon petroleum distillate comprises blending at least one ingredient selected from the group consisting of: kerosene, diesel, naptha, and aliphatics and paraffinnics.

8. The process of claim 7 wherein blending a flow of said hydrocarbon petroleum distillate comprises blending said hydrocarbon petroleum distillate in an amount to form about 43–70% by weight of said hydrocarbon petroleum distillate in said water continuous fuel emulsion.

9. The process of claim 7 wherein blending a flow of said hydrocarbon petroleum distillate comprises blending said hydrocarbon petroleum distillate in an amount to form about 63–68% by weight of said hydrocarbon petroleum distillate in said water continuous fuel emulsion.

10. The process of claim 1 wherein blending a flow of an additive composition comprises blending a flow of antifreeze.

11. The process of claim 10 wherein blending a flow of said additive comprises blending a flow of an antifreeze and a flow of said additive through a third in-line blending station to form said additive composition.

12. The process of claim 11 wherein blending a flow of said antifreeze and a flow of said additive through a third in-line blending station to form said additive composition comprises blending of said antifreeze in an amount to form about 2–9% by weight of said antifreeze in said water continuous fuel emulsion.

13. The process of claim 1 wherein blending a flow of an additive composition comprises blending a flow of surfactant.

14. The process of claim 13 wherein blending a flow of an additive composition comprises blending a flow of surfactant comprising blending a flow of said surfactant in an amount to comprise about 0.3–1% by weight of said surfactant in said water continuous fuel emulsion.

15. The process of claim 13 wherein blending a flow of an additive composition comprises blending a flow of surfactant further comprising blending a flow of said surfactant in an amount to comprise about 0.4–0.6% by weight of said surfactant in said water continuous fuel emulsion.

16. The process of claim 13 wherein blending a flow of said surfactants comprises blending at least one ingredient selected from the group consisting of: alkylphenlethoxylates, alcohol ethoxylates, fatty alcohol ethoxylates and alkyl amine ethoxylates.

17. The process of claim 1 wherein blending a flow of said additive composition comprises blending at least one ingredient selected from the group consisting of: surfactants, lubricants, alkanolamine neutralizers, corrosion inhibitors, antifreezes, ignition delay modifiers, cetane improvers, stabilizers, biocides, anti-foam agents, hydrotropes and rheology modifiers.

18. The process of claim 17 wherein blending a flow of said additive composition comprises blending said additive composition in an amount to form less than 10% by weight of said additive composition in said water continuous fuel emulsion.

19. The process of claim 18 wherein blending a flow of said surfactants comprises blending at least one ingredient selected from the group consisting of: alkylphenlethoxylates, alcohol ethoxylates, fatty alcohol ethoxylates and alkyl amine ethoxylates.

20. The process of claim 1 wherein blending a flow of said additive composition comprises blending at least one antifreeze, at least one surfactant, at least one lubricant, at least one neutralizer, at least one corrosion inhibitor, and at least one ignition delay modifier.

21. The process of claim 18 wherein blending a flow of said additive composition comprises blending said lubricant having at least one ingredient selected from the group consisting of: mono-, di- and tri-acids of the phosphoric or carboxylic types adducted to an organic backbone.

22. The process of claim 21 wherein said organic backbone contains about 12 to about 22 carbons.

23. The process of claim 18 wherein blending a flow of said additive composition comprises blending a flow of said lubricants comprising about 0.04–0.10% by weight of said lubricants in said water continuous fuel emulsion.

24. The process of claim 18 wherein blending a flow of said additive composition comprises blending a flow of said lubricants comprising about 0.04–0.05% by weight of said lubricants in said water continuous fuel emulsion.

25. The process of claim 18 wherein blending a flow of said additive composition comprises blending said alkanolamine neutralizers which comprises blending at least one ingredient selected from the group consisting of: amino methyl propanol, triethanolamine, and diethanolamine.

26. The process of claim 25 wherein said alkanolamine neutralizers comprise about 0.05–0.4% by weight of said water continuous fuel emulsion.

27. The process of claim 25 wherein said alkanolamine neutralizers comprise about 0.06% by weight of water continuous fuel emulsion.

28. The process of claim 25 wherein said alkanolamine neutralizers comprise about 0.05% by weight of said water continuous fuel emulsion.

29. The process of claim 18 wherein blending a flow of said additive composition comprises blending said ignition delay modifier having at least one ingredient selected from the group consisting of: nitrates, nitrites, and peroxides.

30. The process of claim 29 wherein blending a flow of said additive composition comprises blending said ignition delay modifier in an amount to form about 0.01–0.4% by weight of said ignition delay modifier in said water continuous fuel emulsion.

31. The process of claim 29 wherein blending a flow of said additive composition comprises blending said corrosion inhibitor in an amount to form about 0.05% by weight of said corrosion inhibitor in said water continuous fuel emulsion.

32. The process of claim 18 blending a flow of said additive composition comprises blending said antifoam agent in an amount to form less than about 0.0005% by weight of said antifoam agent in said water continuous fuel emulsion.

33. The process of claim 18 wherein blending a flow of said additive composition comprises blending said hydrotropes having at least one ingredient selected from the group consisting of: di- and tri-acids of the Diels Alder adducts of unsaturated fatty acids.

34. The process of claim 33 wherein blending a flow of said additive composition comprises blending said hydrotropes further in an amount to form about 0.04 to 0.1% by weight of said hydrotropes in said water continuous fuel emulsion.

35. The process of claim 33 wherein blending a flow of said additive composition comprises blending said hydrotropes in an amount to form about 0.04–0.05% by weight of said hydrotropes in said water, continuous fuel emulsion.

* * * * *